US006966542B2

(12) United States Patent
Bettencourt

(10) Patent No.: US 6,966,542 B2
(45) Date of Patent: Nov. 22, 2005

(54) MOTORCYCLE LIFT

(75) Inventor: Leland A. Bettencourt, Fresno, CA (US)

(73) Assignee: Eastway Fair Company Limited, Tortola (VG)

( * ) Notice: Subject to any disclaimer, the term of this patent is extended or adjusted under 35 U.S.C. 154(b) by 26 days.

(21) Appl. No.: 10/789,377

(22) Filed: Feb. 28, 2004

(65) Prior Publication Data

US 2005/0189526 A1 Sep. 1, 2005

(51) Int. Cl.[7] ..... B66F 3/00
(52) U.S. Cl. ..... 254/131; 254/8 B; 254/120
(58) Field of Search ..... 254/10 B, 10 C, 254/8 B, 2 B, 2 C, 8 R, 9 C, 131, 120

(56) References Cited

U.S. PATENT DOCUMENTS

| | | | | |
|---|---|---|---|---|
| 2,906,497 A | | 9/1959 | Wolf | 254/10 |
| 4,077,607 A | | 3/1978 | Lovelady | 254/88 |
| 4,324,384 A | * | 4/1982 | Elser | 254/8 B |
| 4,460,158 A | | 7/1984 | Chiesa et al. | 254/124 |
| 5,271,603 A | * | 12/1993 | White | 254/10 C |
| 5,366,338 A | | 11/1994 | Mortensen | 414/563 |
| 5,518,224 A | * | 5/1996 | Anderson | 254/131 |
| 5,769,396 A | | 6/1998 | Tischendorf | 254/131 |
| 5,979,878 A | | 11/1999 | Blankenship | 254/131 |
| 6,070,699 A | | 6/2000 | Bleeker | 187/240 |
| 6,092,787 A | | 7/2000 | Nayman | 254/10 R |
| 6,345,693 B1 | | 2/2002 | Yeo et al. | 187/211 |
| 6,455,869 B1 | | 9/2002 | Cook | 257/7 B |
| 6,464,207 B2 | * | 10/2002 | Creel et al. | 254/131 |
| 6,575,310 B2 | | 6/2003 | Chamoun | 211/22 |
| 6,579,055 B1 | | 6/2003 | Williams | 414/462 |
| 6,598,855 B1 | | 7/2003 | Petrone et al. | 254/10 R |
| 6,648,300 B2 | | 11/2003 | Chamoun | 254/10 B |
| 6,802,493 B2 | * | 10/2004 | Lance | 254/131 |
| 2001/0001636 A1 | | 5/2001 | Klinkenberg | 414/462 |
| 2001/0026756 A1 | | 10/2001 | Mortimore | 414/556 |
| 2003/0099531 A1 | | 5/2003 | Williams | 414/462 |

* cited by examiner

*Primary Examiner*—Lee D. Wilson
(74) *Attorney, Agent, or Firm*—Brinks Hofer Gilson & Lione

(57) ABSTRACT

A lift is provided with a low profile lifting mechanism. The lifting mechanism includes a first member pivotally connected to a base, a second member pivotally connected to the first member and a third member pivotally connected to the second member and to the base. When the lifting mechanism is lowered into the bottom position, the first, second and third members rest flat instead of stacked on each other. As a result, it is possible for the lifting mechanism to fit within the height of the base when the lift is in the bottom position. Thus, the overall height of the lifting mechanism in the bottom position is no more than required for the height of the base and the rollers.

26 Claims, 9 Drawing Sheets

MOTORCYCLE LIFT

BACKGROUND

The present invention relates generally to lifting equipment and particularly to a lift for a vehicle.

Various types of lifting equipment are currently available for raising machines, vehicles and other heavy objects up from a floor. One type of lift that is especially well suited for lifting small vehicles is sometimes referred to as a motorcycle/ATV lift or jack. As the name implies, these lifts are specifically designed for lifting small vehicles. Although the lift capacity of these lifts may vary considerably, typical lift capacities may be about 1,500 lbs.

One problem with current small-vehicle lifts is the manner in which the lifting mechanism is designed. One example of a prior art small-vehicle lift is shown in FIGS. 1 and 2 and is described below. Typically, a prior art small-vehicle lift 10 includes a base 12 with two base members 14. The base members 14 may have upward facing channels 16. In order to make the base 12 rigid, a large middle cross beam 13 is usually provided to rigidly attach the two base members 14 together. As shown, the middle cross beam 13 is relatively thick and extends up from the bottom of the base 12.

As shown in FIG. 2, corresponding first members 18 are pivotally connected 20 to the base members 14 within the channels 16. In order to provide lateral support, the two first members 18 are rigidly attached to each other with a first cross beam 22. As the lift 10 is raised and lowered, the first members 18 rotate around the pivotal connections 20 with the base members 14.

Corresponding second members 24 are also pivotally connected 26 to the first members 18. The second members 24 are designed to support the small vehicle as it is lifted off of the floor. Unlike the first and third members 18, 32 which are usually made from hollow tubes, the second members 24 are typically formed with downward facing channels 28 that sit down upon the ends of the first and third members 18, 32. Thus, as those skilled in the art will readily appreciate, the second members 24 remain parallel to the base 12 as the lift 10 is raised and lowered. Although a cross beam is not required between the second members 24 because of the cross beams 22, 36 between the first and third members 18, 32, a small cross beam 30 may be provided to attach the two second members 24 together.

Corresponding third members 32 are also pivotally connected 34 to the second members 24. In order to provide lateral support, the two third members 34 are rigidly attached to each other with a second cross beam 36. The third members 34 are also pivotally connected 38 to the base members 14. Like the first members 18, the third members 32 rotate around the pivotal connections 38 with the base members 14 as the lift 10 is raised and lowered.

A conventional jack mechanism 40 connected to the base 12 and the third members 32 applies the force that is needed to raise and lower the lift 10. Typically, the jacking mechanism 40 uses a hydraulic cylinder 42 operated by a foot pedal 44. However, other types of jacking mechanisms may also be used.

One problem with conventional small-vehicle lifts like those described above is the way the lifting mechanism folds down in the bottom position. As shown in FIG. 2, the lifting mechanism of the prior art lift 10 sits above the base 12 when the lifting mechanism is lowered all the way down into the bottom position. This is caused by the stacked arrangement of the lifting members 18, 24, 32. For example, as shown in FIGS. 1 and 2, when the lift 10 is lowered down to the bottom position, the first members 18 rest flat within the channels 16 in the base members 14. The forward ends 46 of the third members 32 then rest on top of the rearward ends 48 of the first members 18. Finally, the second members 24 rest on top of the base 12, the first members 18 and the third members 32. As a result of this arrangement, the overall height of the lifting mechanism in the bottom position is approximately equal to the combined heights of the base 12 and the second members 24 or may be even taller if there is a gap between the base 12 and the second members 24.

Although the overall height of the prior art lift in the bottom position is not perceived to be a problem in some applications, this aspect can be a significant problem for other applications. For example, some vehicles are designed with a relatively large space between the chassis of the vehicle and the floor. In these situations, the prior art lift is often not perceived to have any problems since there is sufficient room available under the chassis to maneuver the lift underneath the vehicle.

However, in other applications where the vehicle is designed with a small space between the chassis and the floor, the height of the prior art lifting mechanism may be a major problem. In these situations, the user may need to use other lifting equipment altogether, or the user may partially lift the vehicle with other lifting means until enough space is created to move the lift underneath the vehicle. Even worse, under some circumstances, the user may attempt to manually lift the vehicle onto the lift. This alternative is particularly undesirable because of the safety implications involved.

There are many examples of heavy objects with small spaces underneath the object where these types of problems may be presented. Although it is not possible to enumerate every example, one example of a vehicle with a small space under the chassis may be customized, low-rider motorcycles. Another example may be a scooter. Because of the versatile nature of small-vehicle lifts, it is also common for users to use small-vehicle lifts to lift a variety of other types of broken equipment in addition to small vehicles. For example, a small-vehicle lift may be used to raise a vehicle, or parts thereof, that has been disassembled so that the wheels no longer support the chassis high above the floor. In this case, the space available under the disassembled vehicle may be relatively small. A small-vehicle lift may also be used to raise other miscellaneous equipment that may need to be worked on, such as motors, transmissions, beams, boxes, implements, machines, or any other heavy object that may be found in a shop. Many of these objects may have only small spaces available underneath them for maneuvering a lift or may actually needed to be separately lifted to place the object onto the lift.

Accordingly, it is apparent to the inventor that a lifting mechanism is desired with a smaller overall height when the lift is in the bottom position. A solution to this and other problems is described more fully below.

BRIEF SUMMARY

A lift is described below that has a lower height profile when the lift is in the bottom position than prior art lifts. Unlike prior art lifts that stack the lifting members on top of each other, the described lift arranges the lifting members to avoid stacking of the members. Thus, when the lifting mechanism is lowered down into the bottom position, the members of the lifting mechanism rest fully flat. As result, the described lift may reduce the overall height of the lifting mechanism by about half compared to prior art lifts. This aspect has significant advantages for both convenience and safety. Additional details and advantages are provided below.

BRIEF DESCRIPTION OF SEVERAL VIEWS OF THE DRAWINGS

The invention may be more fully understood by reading the following description in conjunction with the drawings, in which.

DETAILED DESCRIPTION

Figure 8:
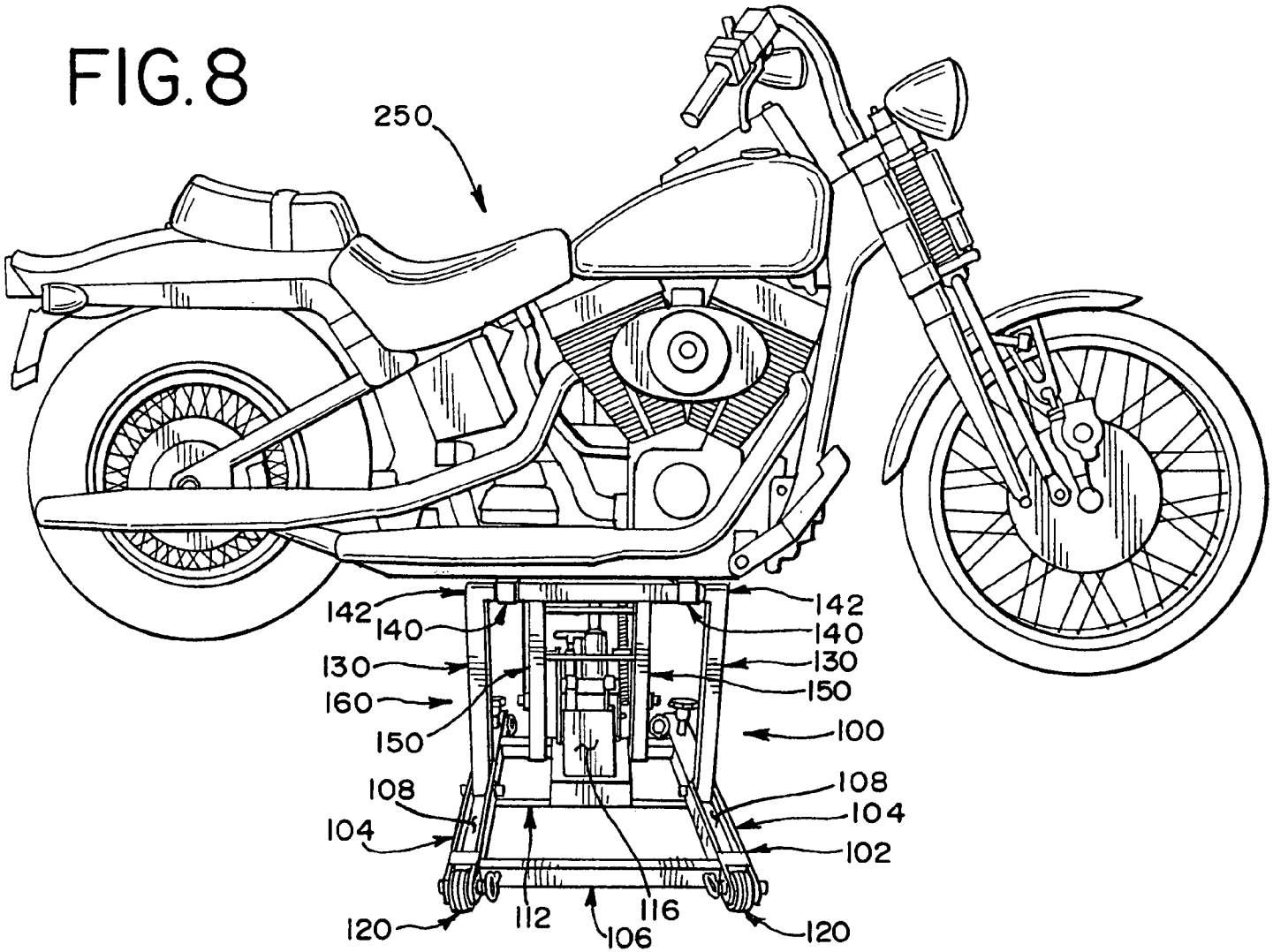
FIG. 8 is a front perspective view of the embodied lift, showing a motorcycle being raised by the lift.
Figure 9:
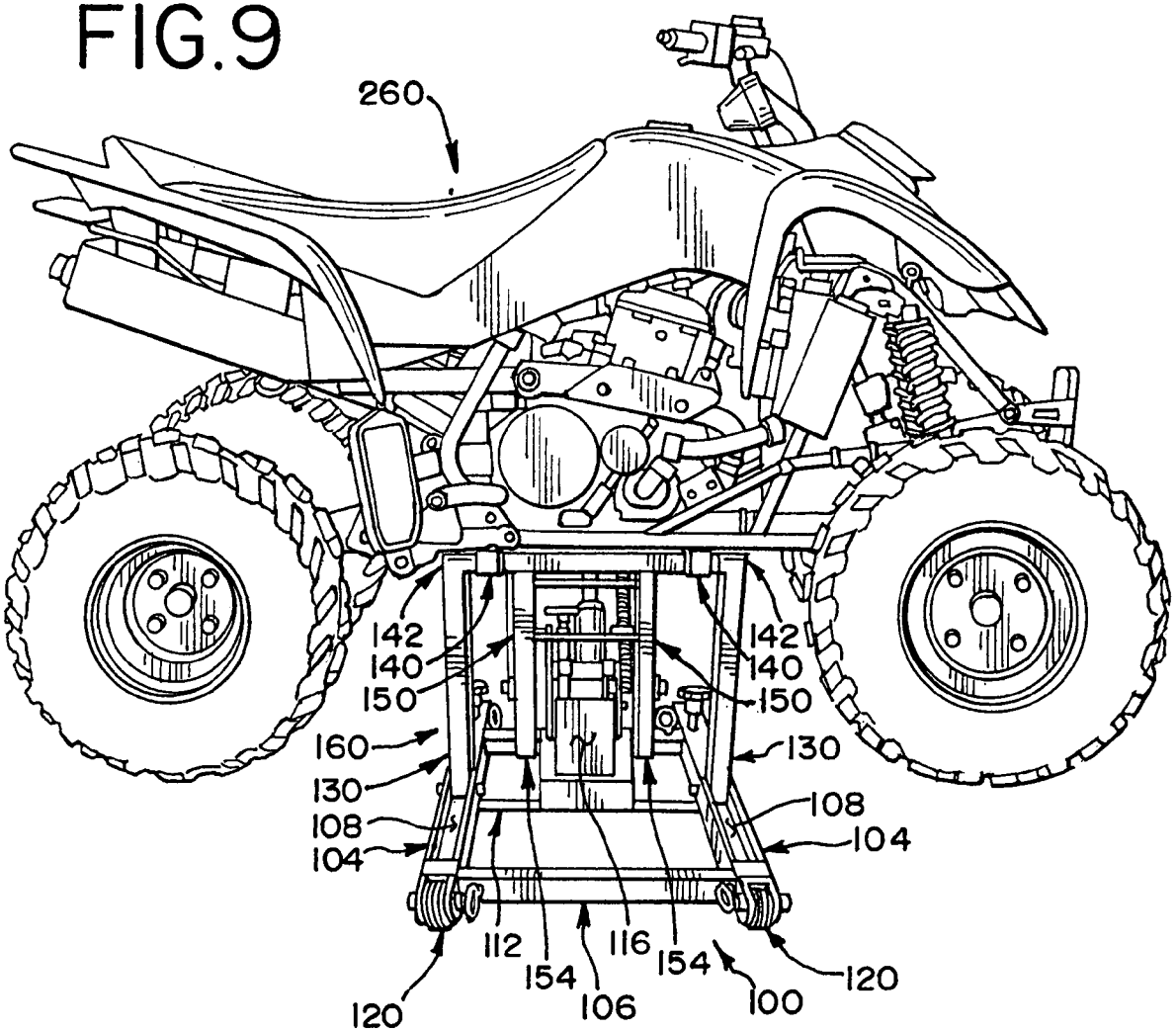
FIG. 9 is a front perspective view of the embodied lift, showing an all-terrain vehicle being raised by the lift.

Referring now to the drawings, and particularly to FIGS. 3–9, a lift 100 for a small vehicle is shown. As shown in FIGS. 8 and 9, the lift 100 may be used to lift small-vehicles, such as a motorcycle 250 or an all-terrain vehicle 260. However, the invention may have other uses as well. The lift 100 generally includes a base 102, front and rear rollers 120, 121, a lifting mechanism 160, a jacking mechanism 170 and a handle 190.

The lifting mechanism 160 is the structure that actually lifts an object up from a floor. The lifting mechanism 160 generally includes at least a base 102, a first member 130, a second member 140 and a third member 150. As is typical, the first member 130 is pivotally connected 132 to the base 102. The second member 140 is pivotally connected 142 to the first member 130. The third member 150 is pivotally connected 152 to the second member 140. The third member 150 is also pivotally connected 154 to the base 102.

Figure 5:
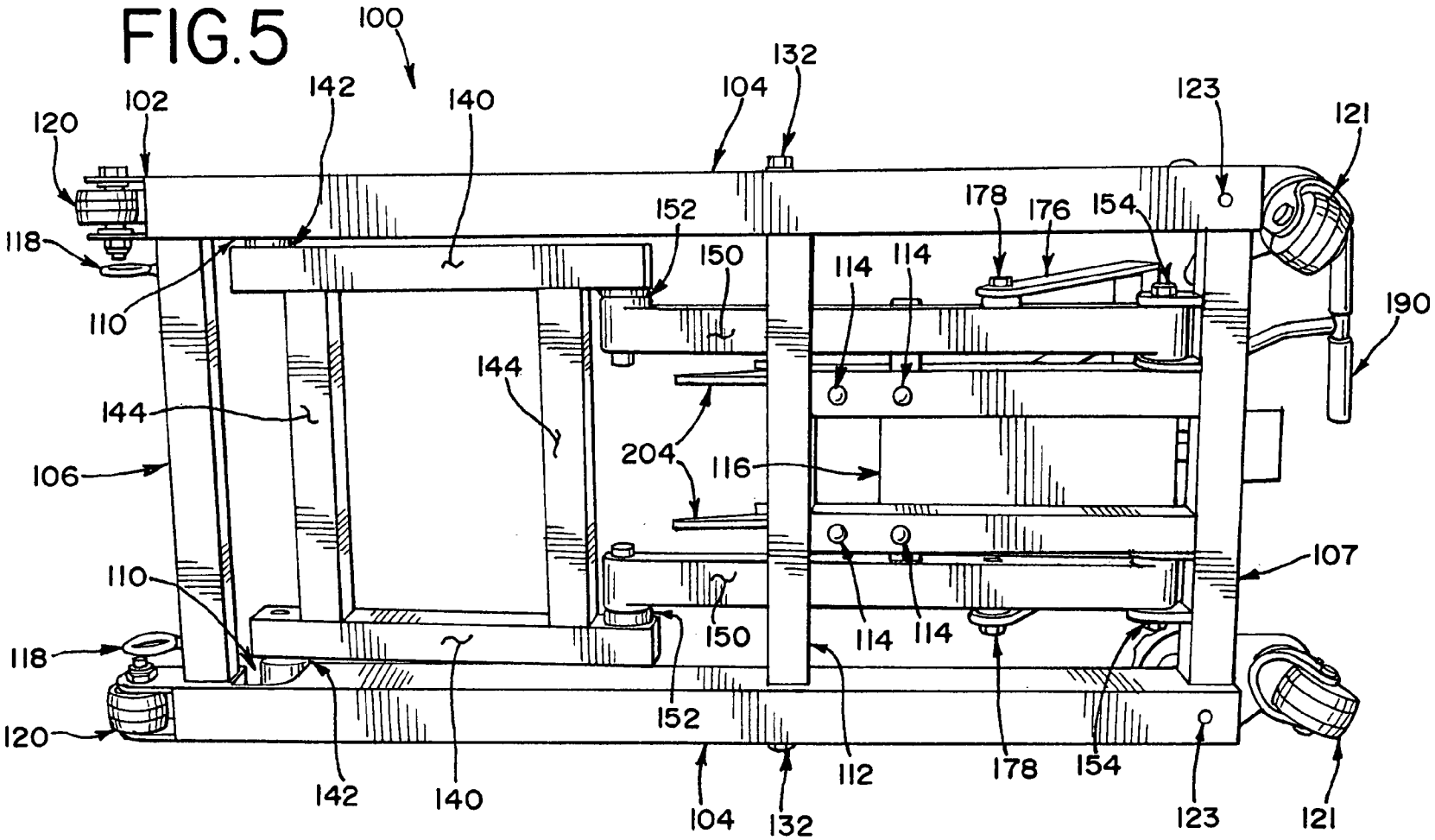
FIG. 5 is a bottom perspective view of the embodied lift.

The base 102 includes corresponding right and left base members 104 rigidly attached to each other with front and rear cross beams 106, 107. The base members 104 are made from tubing with upward facing channel openings 108 formed along the front part of the base members 104. The base members 104 also include corresponding slots 110 extending through the inner sides of the base members 104. The slots 110 are open along the top of the base members 104 to allow the pivot connections 142 between the first members 130 and the second members 140 to rest within the slots 110. Because the forward ends of the base members 104 are open on two sides (i.e., the channels 108 on the tops and the slots 110 on the inner sides), it may be desirable to provide additional reinforcements for the base members 104, such as additional flat metal welded to the sides or the like. In addition, because the lifting mechanism 160 rests fully flat in the bottom position as described below, there is minimal room to place a large middle cross beam between the base members 104 as is frequently done on prior art lifts. Because of this, it is preferable to provide other types of support in place of the middle cross beam. For example, as shown in FIG. 5, a flat beam 112 may be provided at the bottom of the base 102 to attach the base members 104. The flat beam 112 avoids interference since it does not extend upward from the bottom of the base 102. Spherical roller balls 114 that contact the floor may also be provided on the bottom of the jack support 116. However, other types of supports may be possible for ensuring that the base 102 remains rigid.

The base 102 also includes front and rear hooks 118,119. The hooks 118, 119 may be used for various purposes, such as hanging the lift 100 for storage, strapping an object to the lift mechanism 160 for safety, or for pulling on the lift 100. Front and rear rollers 120,121 are also provided. In the embodiment shown, the front rollers 120 are non-pivoting rollers, while the rear rollers 121 are pivoting rollers. However, other arrangements may be used as desired. If desired, locking mechanisms may also be provided on the rear rollers 121, in order to stop the lift 100 from rolling once the lift 100 has been positioned for lifting. Levelers 122 are also provided along the rear end of the base members 104. The levelers 122 are threaded through the base members 104, and the shaft 123 of the levelers 122 extends through the bottom of the base members 104 to contact the floor.

Figure 1:
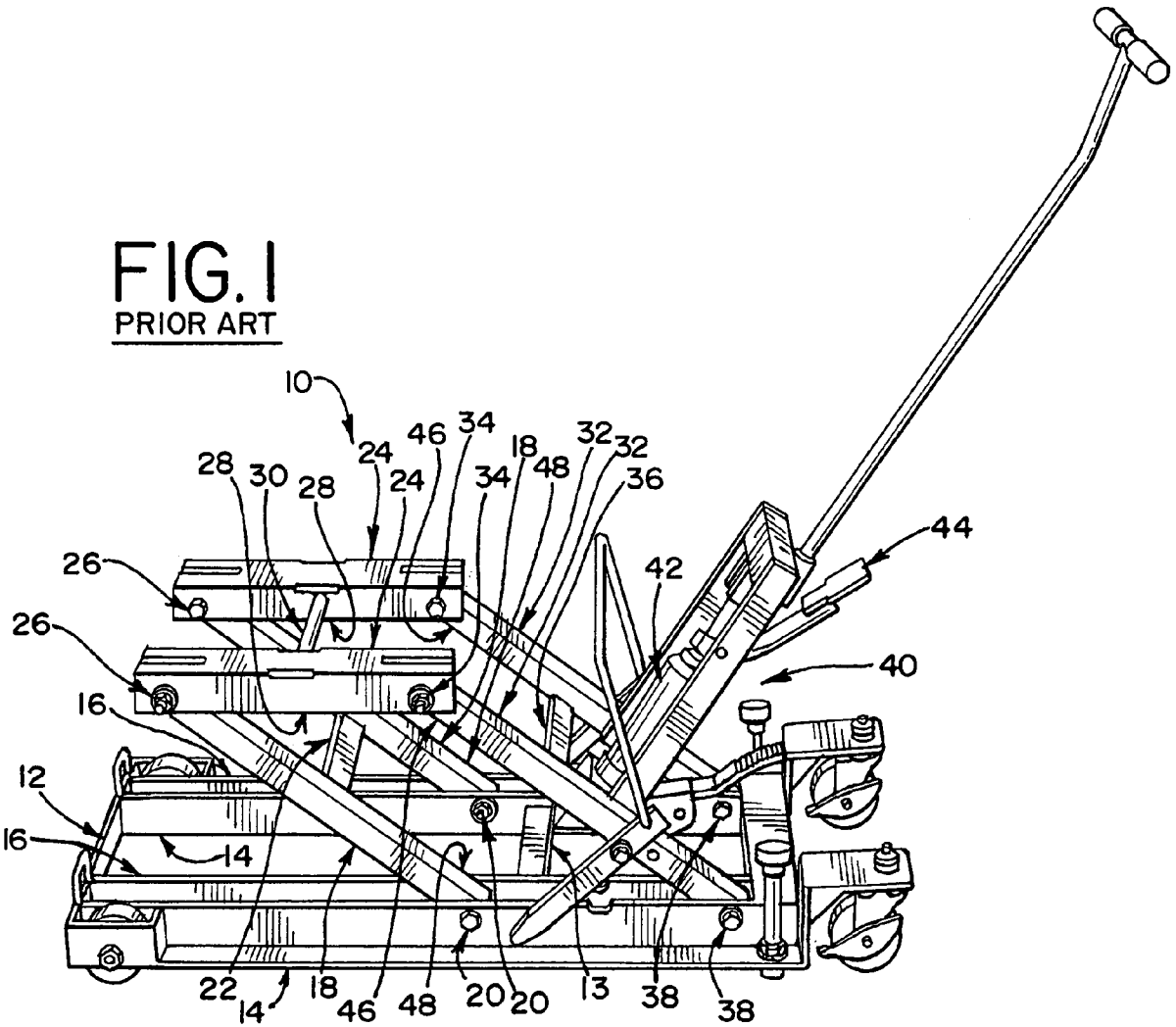
FIG. 1 PRIOR ART
FIG. 1 is a side perspective view of a prior art lift, showing the lift in a raised position.
Figure 2:
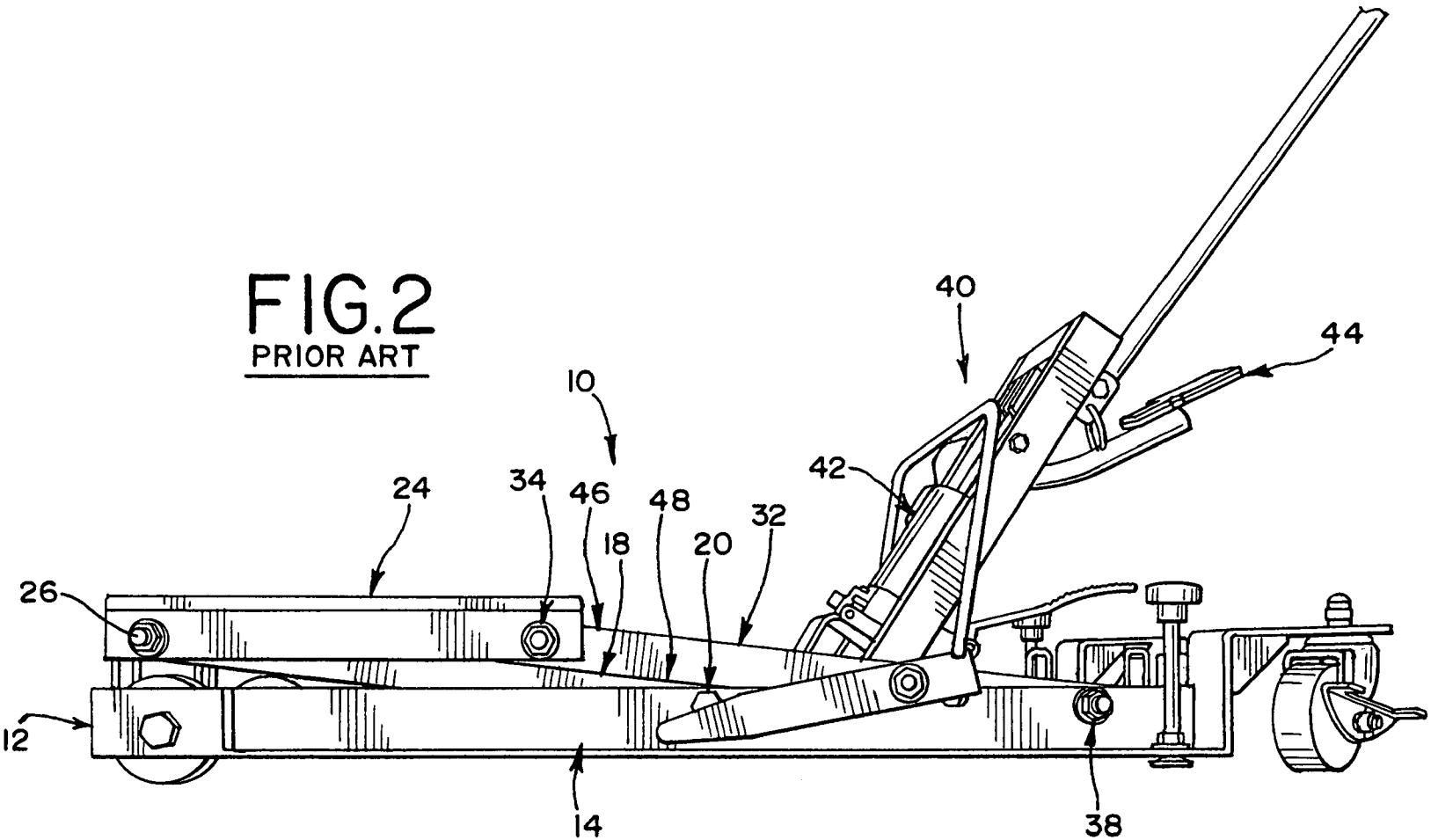
FIG.2 PRIOR ART
FIG. 2 is a side perspective view of the prior art lift, showing the lift in a bottom position.
Figure 3:
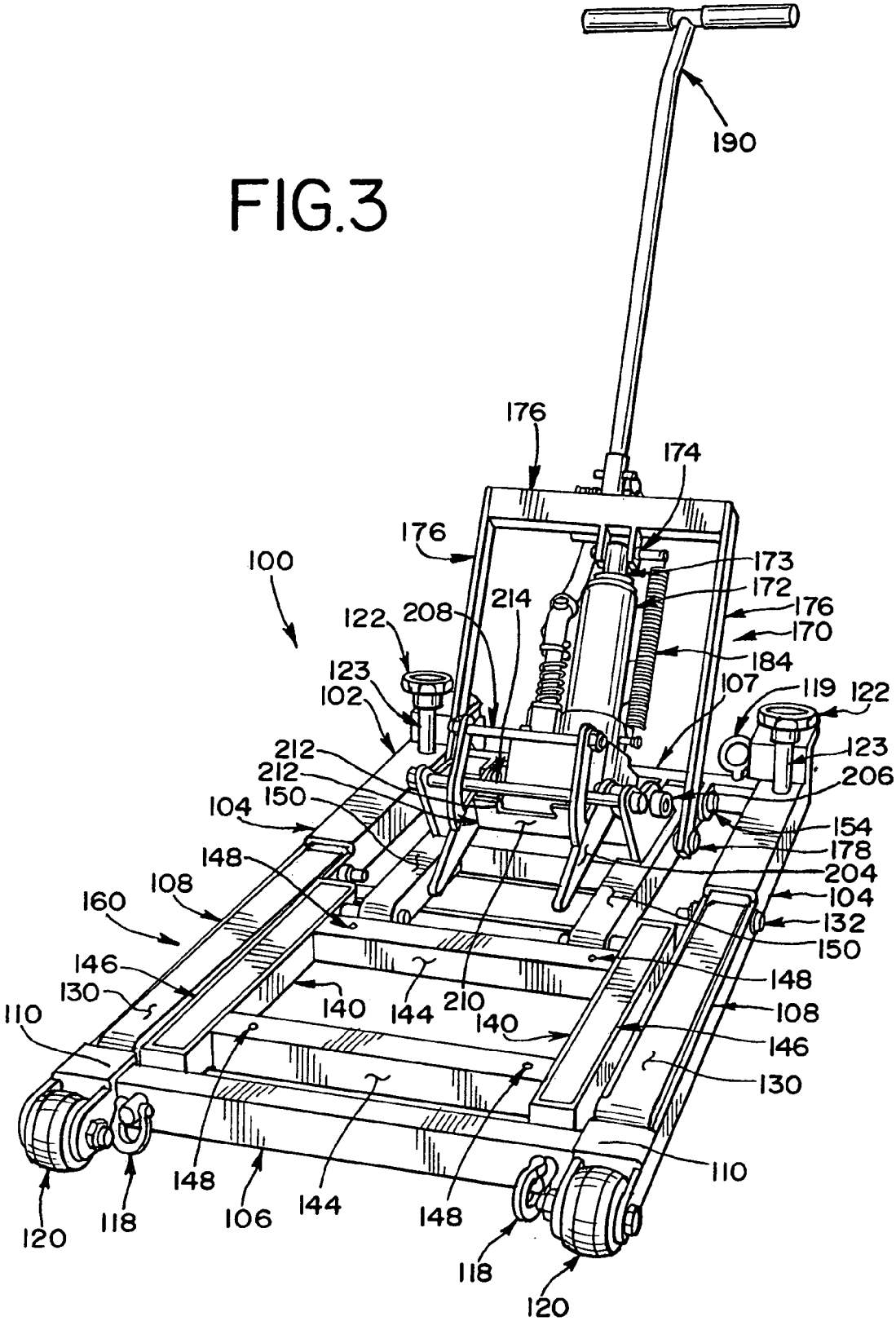
FIG. 3 is a forward perspective view of one embodiment of the invented lift.
Figure 4:
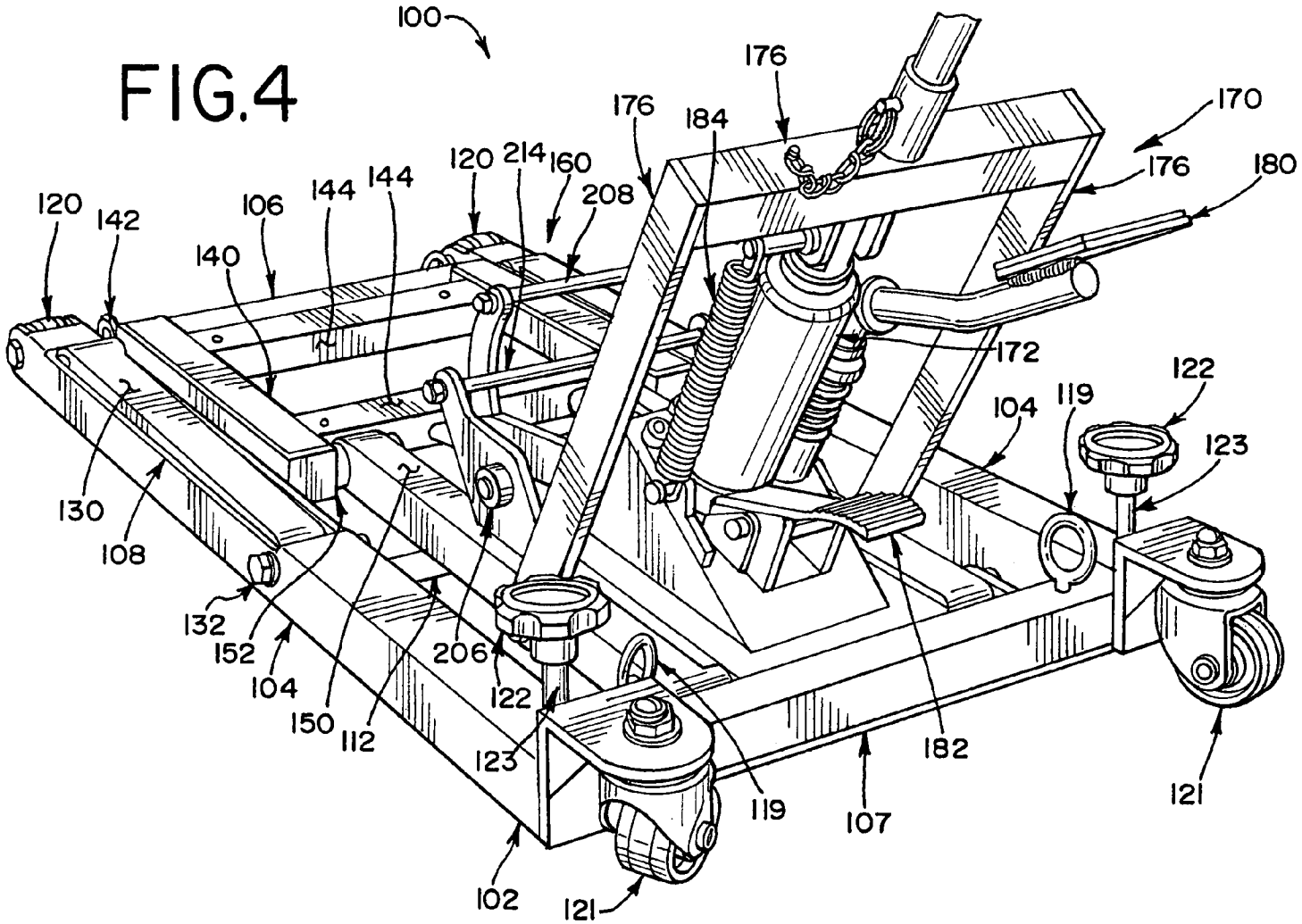
FIG. 4 is a rearward perspective view of the embodied lift.
Figure 6:
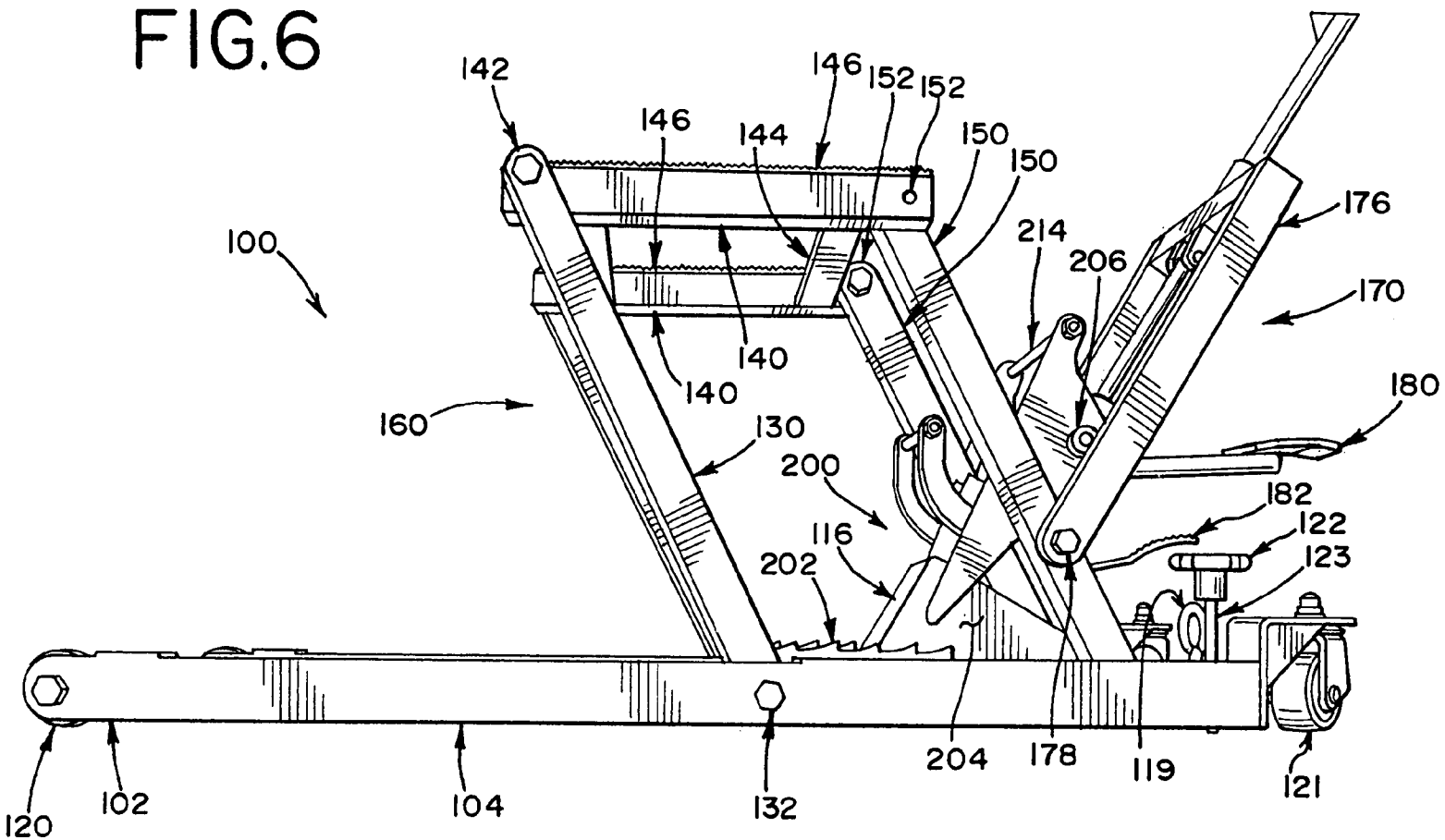
FIG. 6 is a side perspective view of the embodied lift, showing the lift in a raised position.
Figure 7:
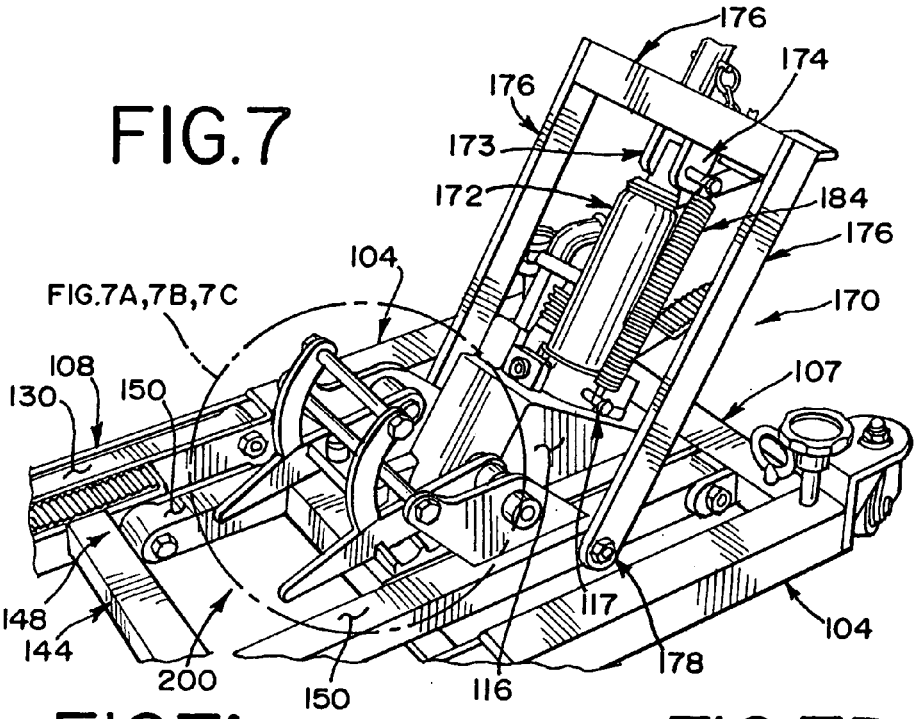
FIG. 7 is a top perspective view of a portion of the embodied lift, showing the jacking mechanism and the safety latch.
Figure 7A:
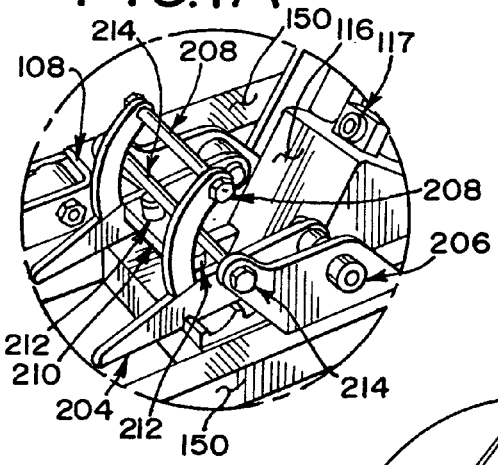
FIG. 7A is a close-up top perspective view of the safety latch.
Figure 7B:
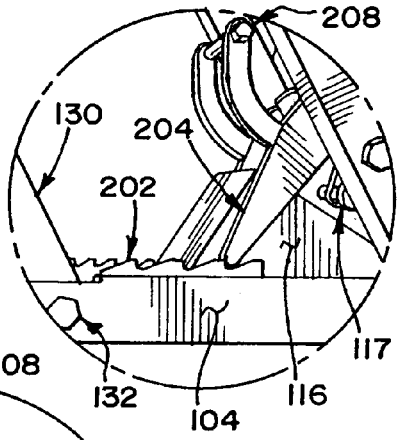
FIG. 7B is a close-up side perspective view of the safety latch, showing the safety latch engaged.
Figure 7C:
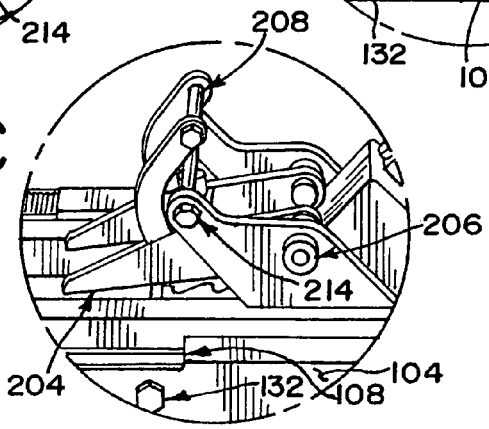
FIG. 7C is a close-up side perspective view of the safety latch, showing the safety latch disengaged.

Corresponding right and left first members 138 are pivotally connected 132 to a middle region of the base members 104 within the open channels 108. Throughout this description, the pivot connections that are described generally include a bolt with a bearing surface and a bushing. However, other types of pivot connections may also be suitable. As shown in FIG. 3, the first members 130 rest flat within the channel openings 108 when the lift 100 is in the bottom position. Among other factors, this is made possible in part by the slots 110 in the base members 104, which allows the pivot connections 142 between the first and second members 140,150 to drop down into the slots 110. As shown in FIG. 6, the first members 130 rotate around the pivot connections 132 with the base members 104 when the lift 100 is raised. As further shown and described below, the second and third members 140,150 are disposed inside of the first members 130. Because an object of the invention is to provide a low profile lifting mechanism 160 in the bottom position, no cross beam is provided to attach the first members 130 together because this type of cross beam would interfere with the second and/or third members 140,150.

Corresponding right and left second members 140 are pivotally connected 142 to the forward ends of the first members 130. As shown in FIG. 3, the second members 140 are connected to the inner sides of the first members 130. Thus, the first members 130 and the second members 140 are disposed along separate vertical planes. This allows the second members 140 to rest flat adjacent the first members 130 when the lift 100 is in the bottom position. As further shown in FIG. 6, the second members 140 remain parallel to the base members 104 when the lift 100 is raised. Like the first and third members 130, 150, the second members 140 are made from square tubing that has a fully enclosed cross section. The second members 140 are rigidly attached together by two cross beams 144 to provide lateral support for the lifting mechanism 160. Preferably, the cross beams 144 are made from hollow tubing like the second members 140 so that the top surfaces of the cross beams 144 are flush with the top surfaces of the second members 140. The second members 140 and the cross beams 144 are designed to provide a support surface for objects placed on the lift 100. Therefore, rubber grips 146 are provided on the top surfaces of the second members 140. Further, vertical holes 148 are provided in the cross beams 144 to allow objects placed on the lift 100 to be secured with hooks, screws and the like.

Corresponding right and left third members 150 are pivotally connected 152 to the rearward ends of the second members 148. The rearward ends of the third members 150 are also pivotally connected 154 to the rear cross beam 107 of the base 102, and not to the base members 104. As shown in FIG. 3, the third members 150 are connected to the inner sides of the second members 140. Thus, the third members 150 and the second members 140 are disposed along separate vertical planes. This allows the third members 150 to rest flat adjacent the second members 140 when the lift 100 is in the bottom position. As further shown in FIG. 6, the third members 150 rotate around the pivot connections 154 with the cross beam 107 of the base 102 when the lift 100 is raised.

The jacking mechanism 170 supplies the force that is needed to raise and lower the lifting mechanism 160. The jacking mechanism 170 includes a hydraulic jack 172 mounted along the bottom to a jack support 116. The jack support 116 is attached to the base 102 and provides an angled surface 117 for the jack 172 to rest upon. The rod 173 of the jack 172 is pivotally connected 174 to a jack cross beam 176, or lifting member. The jack cross beam 176 is also pivotally connected 178 to the third members 150. Pressure is supplied to the jack 172 by a foot pedal 180, thereby extending the rod 173 upward. Another foot pedal 182 is used to release the jack pressure, thereby drawing the rod 173 back down. A handle 190 is attached to the jack cross beam 176 in order to maneuver the lift 100 by rolling the lift 100 on the rollers 120,121.

Thus, when the pressure foot pedal 178 is pumped, the jack 172 applies an upward force on the jack cross beam 176. This pulls upward on the third members 150 through the pivot connection 178 between the jack cross beam 176 and the third members 150. As a result, the lifting mechanism 160 raises as shown in FIG. 6. To lower the lifting mechanism 160, the release foot pedal 182 is pressed, thereby releasing the jack pressure. This causes the rod 173 of the jack 172 to move downward into the jack 172 due to the compressive force of the spring 184, in addition to the weight of the lifting mechanism 160 and the jack cross beam 176. As a result, the lifting mechanism 160 lowers in a reverse manner until the lifting mechanism 160 reaches the bottom position.

To provide additional safety, a safety latch 200 is also provided with the jacking mechanism 170. The safety latch 200 includes a pair of teeth 202, or cogs, attached to the base 102. A pair of engaging members 204, or dogs, are pivotally connected 206 to the third members 150. A handle 208 attached to the engaging members 204 is further provided. The engaging members 204 are attached together with a cross beam 210, and a pair of magnets 212 are affixed to the cross beam 210. A metal bar 214 is also provided which is attached between the third members 150 and is positioned above the magnets 212.

Thus, the operation of the safety latch 200 is now apparent. As the lift 100 is raised, the engaging members 204 rotate around the pivot connection 206 with the third member 150. The engaging members 204 then engage the teeth 202 on the base 102. As the height of the lifting mechanism 160 increases, the engaging members 204 ride over the teeth 202 while remaining engaged with the teeth 202 that are closest in proximity to the engaging members 204. Therefore, if the jack pressure is suddenly released when the lifting mechanism 160 is in a raised position, the engaging members 204 will lock within the teeth 202 and will prevent the lifting mechanism 160 from lowering. Accordingly, in order to lower the lifting mechanism 160, the engaging members 204 must be disengaged from the teeth 202 before the jack pressure is released. This is accomplished by pulling upward on the latch handle 208 to rotate the engaging members 204 away from the teeth 202 until the magnets 212 contact the metal bar 214. The attraction between the magnets 212 and the metal bar 214 will now prevent the engaging members 204 from engaging the teeth 202 on the base 102. As a result, when the jack pressure is released, the lifting mechanism 160 will now lower without being restrained by the safety latch 200.

The jacking mechanism 170 that has been shown and described is only one example of a jacking mechanism that may be used with the lift mechanism 160. For example, it may be possible that other jacking mechanisms may also be used with the lifting mechanism 160, such as lever operated hydraulic mechanisms or even electric or pneumatic systems. Moreover, although the described safety latch 200 may have some advantages, other types of safety latches may also be used. For example, in some applications spring loaded safety latches may be preferred or the safety latch may be widened and/or moved rearward if a longer lifting area is desired.

The advantages of the lift 100 are now apparent. Because the first, second and third members 130, 140, 150 are all arranged side-by-side, the lifting mechanism 160 rests fully flat in the bottom position. This is possible because each of the first, second and third members 130, 140, 150 are disposed in separate vertical planes. Thus, when the lifting mechanism 160 is in the bottom position, the first, second and third members 130, 140, 150 are disposed in the same horizontal plane. This arrangement provides a height profile when the lift 100 is in the bottom position that is significantly lower than prior art lifts. For example, the top surface of prior art lifts is typically about 5 inches above the floor. By comparison, a similar lift that utilizes the concepts taught herein may have a top surface that is only about 2⅜ inches above the floor. In this example, the preferred embodiment used 2 inch high base members 104 and the rollers 120, 121 increased the overall height to 2⅜ inches. However, other variations are possible. Thus, whereas the prior art lifts stack the lifting members on top of each other, the invented lift 100 essentially encompasses only a single thickness of the lifting members 130, 140, 150 since the lifting members 130, 140, 150 are positioned side-by-side instead of stacked.

The lower profile of the invented lift is a significant improvement over prior art lifts. The primary advantage is that the lift can be maneuvered more easily underneath objects that need to be lifted. This is especially important for objects with only a small amount of space under them. This may be particularly helpful for lifting many different kinds of objects, including without limitation custom-made motorcycles, scooters and any other type of equipment positioned close to the floor. Similarly, the lift provides a greater range of lift travel, with the increased lift travel having been added to the bottom travel range. Thus, the lift is capable of lifting objects from a lower starting point than prior art lifts.

In addition the convenience of a lower profile lift, the invented lift also significantly improves the safety of lifts as well. With prior art lifts, it is not uncommon for the user to separately lift the object to be lifted onto the lift. This may create a safety concern because the object to be lifted may not be secured while the object is lifted onto the lift. As a result, the object to be lifted may fall while the user is trying to separately lift the object onto the lift. By contrast, the invented lift may avoid the need for separately lifting objects onto the lift. As a result, the object to be lifted can be secured to the lift before ever lifting the object at all. This prevents the risk of objects falling while lifting them onto the lift.

The lower profile of the lift may also offer other advantages. For example, because the lifting mechanism lays flat in the bottom position, the lift may be easier to store when the lift is not being used. The improvements provided by the lift may also find use in other applications that prior art small-vehicle lifts have not been considered for.

Accordingly, it is now apparent that there are many advantages of the invention provided herein. In addition to the advantages that have been described, it is also possible that there are still other advantages that are not currently recognized but which may become apparent at a later time.

While preferred embodiments of the invention have been described, it should be understood that the invention is not so limited, and modifications may be made without departing from the invention. The scope of the invention is defined by the appended claims, and all devices that come within the meaning of the claims, either literally or by equivalence, are intended to be embraced therein.

I claim:

1. A lift for a small vehicle, such as a motorcycle or an all-terrain vehicle, comprising:

a lifting mechanism movable from a bottom position to a raised position, said lifting mechanism comprising:

a base disposed adjacent a floor in both said bottom position and said raised position;

a first member pivotally connected to said base, said first member being rotatable between said bottom position and said raised position;

a second member pivotally connected to said first member, said second member remaining parallel to said base in both said bottom position and said raised position, wherein said second member is adapted to support said small vehicle;

a third member pivotally connected to said second member and pivotally connected to said base, said third member being rotatable between said bottom position and said raised position;

wherein said first member, said second member and said third member are disposed side-by-side, each of said first member, said second member and said third member being disposed along separate vertical planes; and wherein said first member, said second member and said third member are disposed along the same horizontal plane in said bottom position.

2. The lift according to claim 1, wherein said base comprises a channel, said first member being disposed within said channel.

3. The lift according to claim 2, wherein said base further comprises a slot extending through a side of said base, said pivotal connection between said first member and said base being disposed within said slot in said bottom position.

4. The lift according to claim 1, further comprising a jack and a lift member, said jack being attached at one end to said base and pivotally connected at another end to said lift member, said lift member being further pivotally connected to said third member.

5. The lift according to claim 1, further comprising corresponding right and left first members, corresponding right and left second members, and corresponding right and left third members.

6. The lift according to claim 5, wherein said second members are formed from tubing with a fully enclosed cross section.

7. The lift according to claim 6, further comprising two cross beams rigidly attached to said corresponding second members, top surfaces of said cross beams being flush with top surfaces of said second members.

8. The lift according to claim 7, further comprising at least one hole in each of said two cross beams, said vehicle being securable to said holes.

9. The lift according to claim 8, further comprising a jack and a lift member, said jack being attached at one end to said base and pivotally connected at another end to said lift member, said lift member being further pivotally connected to said third member; wherein said base comprises a channel, said first member being disposed within said channel, said base further comprising a slot extending through a side of said base, said pivotal connection between said first member and said base being disposed within said slot in said bottom position.

10. A lift for a small vehicle, such as a motorcycle or an all-terrain vehicle, comprising:

a base comprising a channel facing upwards;

a first member pivotally connected to said base, said first member being disposed within said channel;

a second member pivotally connected to one side of said first member, said second member and said first member being disposed along separate vertical planes;

a third member pivotally connected to one side of said second member and pivotally connected to said base, said third member and said second member being disposed along separate vertical planes;

wherein said first member, said second member and said third member are disposed along the same horizontal plane when said lift is in a bottom position.

11. The lift according to claim 10, further comprising corresponding right and left first members, corresponding right and left second members, and corresponding right and left third members; wherein said base further comprises slots extending through sides of said base, said pivotal connections between said first members and said base being disposed within said slots in said bottom position.

12. The lift according to claim 11, further comprising a jack and a lift member, said jack being attached at one end to said base and pivotally connected at another end to said lift member, said lift member being further pivotally connected to at least one of said third members; wherein said second members are formed from tubing with a fully enclosed cross section.

13. A lift for raising a small vehicle, said lift moveable between a bottom position and a raised position, said bottom position adapted for maneuvering said lift under said small vehicle and said raised position adapted to lift said small vehicle above a floor, comprising:

a base disposed parallel to a floor;

a first member pivotally connected to said base;

a second member pivotally connected to said first member, said second member being disposed adjacent an inner side of said first member;

a third member pivotally connected to said second member and pivotally connected to said base, said third member being disposed adjacent an inner side of said second member;

wherein said first member, said second member and said third member are each disposed along separate vertical planes.

14. The lift according to claim 13, further comprising corresponding right and left first members, corresponding right and left second members, and corresponding right and left third members; wherein said base comprises channels, said first members being disposed within said channels, said base further comprising slots extending through sides of said base, said pivotal connections between said first members and said base being disposed within said slots in said bottom position; and further comprising a jack and a lift member, said jack being attached at one end to said base and pivotally connected at another end to said lift member, said lift member being further pivotally connected to at least one of said third members.

15. A lift for raising a small vehicle, said lift moveable between a bottom position and a raised position, said bottom position adapted for maneuvering said lift under said small vehicle and said raised position adapted to lift said small vehicle above a floor, comprising:

a base member comprising a channel;

a first member pivotally connected to said base member, said first member being disposed within said channel;

a second member pivotally connected to said first member, said second member being disposed along a side of said first member;

a third member pivotally connected to said second member and pivotally connected to said base member, said third member being disposed along a side of said second member;

wherein said first member, said second member and said third member are disposed side-by-side, said first member, said second member, said third member and said base member being disposed along the same horizontal plane when said lift is in said bottom position, a height of said first member, said second member and said third member being no higher than a height of said base member, whereby said first member, said second member and said third member rest within said height of said base member when said lift is in said bottom position.

16. The lift according to claim 15, wherein said base further comprises a slot extending through a side of said base, said pivotal connection between said first member and said base being disposed within said slot in said bottom position.

17. The lift according to claim 16, further comprising corresponding right and left first members, corresponding right and left second members, and corresponding right and left third members.

18. The lift according to claim 17, further comprising a jack and a lift member, said jack being attached at one end to said base and pivotally connected at another end to said lift member, said lift member being further pivotally connected to at least one of said third members.

19. A lift for raising an object, said lift moveable between a bottom position and a raised position, said bottom position adapted for positioning said object over said lift and said raised position adapted to lift said object above a floor, comprising:

a base comprising corresponding base members disposed parallel to a floor;

corresponding first members pivotally connected to a middle region of said base members;

corresponding second members pivotally connected to forward ends of said first members and extending rearward therefrom, said second members being disposed adjacent inner sides of said first members;

corresponding third members pivotally connected to rearward ends of said second members and extending rearward therefrom, said third members being disposed adjacent inner sides of said second members, rearward ends of said third members being pivotally connected to said base;

wherein said first members are further characterized by the absence of a cross beam attached between said corresponding first members.

20. The lift according to claim 19, further comprising at least one cross beam rigidly attached to said corresponding second members.

21. The lift according to claim 20, wherein said base further comprises a rear cross beam rigidly attached to rearward ends of said base members, said rearward ends of said third members being pivotally connected to said rear cross beam.

22. The lift according to claim 21, wherein said base further comprises a flat cross beam rigidly attached to a middle region of said base members, said flat cross beam extending along a bottom of said base without extending up from said bottom of said base.

23. A lift for raising an object, said lift moveable between a bottom position and a raised position, said bottom position adapted for positioning said object over said lift and said raised position adapted to lift said object above a floor, comprising:

a base comprising corresponding base members disposed parallel to a floor and a rear cross beam rigidly attached to rearward ends of said base members;

corresponding first members pivotally connected to a middle region of said base members;

corresponding second members pivotally connected to forward ends of said first members and extending rearward therefrom, said second members being disposed adjacent inner sides of said first members;

corresponding third members pivotally connected to rearward ends of said second members and extending rearward therefrom, said third members being disposed adjacent inner sides of said second members, rearward ends of said third members being pivotally connected to said rear cross beam.

24. The lift according to claim 23, further comprising a jack and a lift member, said jack being attached at one end to said base and pivotally connected at another end to said lift member, said lift member being further pivotally connected to at least one of said third members.

25. The lift according to claim 24, wherein said base members comprise upward facing channels, said first members being disposed within said channels, said base members further comprising slots extending through side of said base members, said pivotal connections between said first members and said base members being disposed within said slots in said bottom position.

26. The lift according to claim 25, wherein said second members are formed from tubing with a fully enclosed cross section; further comprising at least one cross beam rigidly attached to said corresponding second members, said cross beam comprising at least two securing holes; and wherein said first members are further characterized by the absence of a cross beam attached between said corresponding first members.

* * * * *